US012275114B2

(12) United States Patent
Chen et al.

(10) Patent No.: US 12,275,114 B2
(45) **Date of Patent: *Apr. 15, 2025**

(54) BELT SANDER

(71) Applicant: BASSO INDUSTRY CORP., Taichung (TW)

(72) Inventors: Yu-Da Chen, Taichung (TW); Ching-Chih Ho, Taichung (TW)

(73) Assignee: Basso Industry Corp., Taichung (TW)

( * ) Notice: Subject to any disclaimer, the term of this patent is extended or adjusted under 35 U.S.C. 154(b) by 395 days.

This patent is subject to a terminal disclaimer.

(21) Appl. No.: 17/674,548

(22) Filed: Feb. 17, 2022

(65) Prior Publication Data

US 2022/0266412 A1 Aug. 25, 2022

(30) Foreign Application Priority Data

Feb. 19, 2021 (TW) ..... 110105762

(51) Int. Cl.
*B24B 23/06* (2006.01)
*B24B 21/20* (2006.01)
(Continued)

(52) U.S. Cl.
CPC ..... *B24B 23/06* (2013.01); *B24B 21/20* (2013.01); *B24B 23/022* (2013.01);
(Continued)

(58) Field of Classification Search
CPC ..... B24B 23/06; B24B 21/20; B24B 23/022; B24B 23/02; B24B 41/04; B24B 47/12; B24B 27/0084; B24B 27/00; B24B 21/18; B24B 21/22; B24B 23/028; B25F 5/02; B23B 45/001; Y10S 16/39; Y10S 16/90;
(Continued)

(56) References Cited

U.S. PATENT DOCUMENTS 10,427,270 B2 10/2019 Johnson et al.
2002/0194737 A1* 12/2002 Bartmann ..... B24B 45/00 30/276

(Continued)

FOREIGN PATENT DOCUMENTS

TW I593506 B 8/2017

OTHER PUBLICATIONS

Search Report issued to European counterpart application No. 22157052.6 by the EPO on Jul. 25, 2022.

*Primary Examiner* — Tyrone V Hall, Jr.
*Assistant Examiner* — Kent N Shum
(74) *Attorney, Agent, or Firm* — Burris Law, PLLC

(57) ABSTRACT

A belt sander includes: a power unit having a rotating shaft; a rotatable belt casing defining a track groove that is open toward the power unit and that surrounds the rotating shaft, and having a plurality of engaging portions that are arranged around the track groove; an abrasive belt drivable by the rotating shaft; and a positioning unit including a movable positioning member that is adapted for manual operation, and an engaging member that is co-movably connected to the positioning member. The positioning unit is movable between an engaging position, where the engaging member is engaged with a selected one of the engaging portions, and a releasing position, where the engaging member is disengaged from the engaging portions.

10 Claims, 11 Drawing Sheets

(51) Int. Cl.

| | |
|---|---|
| ***B24B 23/02*** | (2006.01) |
| ***B24B 27/00*** | (2006.01) |
| ***B24B 41/04*** | (2006.01) |
| ***B24B 47/12*** | (2006.01) |

(52) U.S. Cl.
CPC ..... *B24B 27/0084* (2013.01); *B24B 41/04* (2013.01); *B24B 47/12* (2013.01)

(58) Field of Classification Search
CPC ..... Y10S 16/901; Y10S 16/12; Y10S 16/24; Y10S 16/25; Y10T 403/32426
USPC ..... 16/430, 319; 403/104
See application file for complete search history.

(56) References Cited

U.S. PATENT DOCUMENTS

| | | | | |
|---|---|---|---|---|
| 2018/0093359 | A1* | 4/2018 | Johnson | B24B 47/12 |
| 2022/0176512 | A1* | 6/2022 | Ho | B24B 47/12 |

* cited by examiner

BELT SANDER

CROSS-REFERENCE TO RELATED APPLICATION

This application claims priority of Taiwanese Patent Application No. 110105762, filed on Feb. 19, 2021.

FIELD

The disclosure relates to a power sander, and more particularly to a belt sander.

BACKGROUND

Referring to FIGS. 1 and 2, a conventional belt sander 1 disclosed in U.S. patent Ser. No. 10/427,270 includes a housing 11, a motor unit 12 mounted in the housing 11, a belt arm 13 rotatably connected to the housing 11, a belt 14 mounted to the belt arm 13, and an engaging member 15 co-rotatable mounted to the belt arm 13, and adapted for manual operation. The housing 11 includes an annular portion 111 sleeved on the belt arm 13, and having a plurality of grooves 112 that surround an axis (X). The motor unit 12 includes a rotating shaft 121 being rotatable about the axis (X) and configure to drive the belt 14 for grinding or polishing an object (not shown). The engaging member 15 has an end portion extending radially toward the rotating shaft 121 and is configured to be engaged with one of the grooves 112 so as to position the belt arm 13 at a desired angular position with respect to the housing 11.

However, since the engaging member 15 is co-rotatable with the belt arm 13, when the angular position of the belt arm 13 varies, the position of the engaging member 15 varies as well. That is, when a user is operating on the engaging member 15 in order to adjust the angular position of the belt arm 13, the hand of the user that is operating on the engaging member 15 needs to follow the rotation of the belt arm 13 at the same time, which can be difficult for the user to apply force during the process.

SUMMARY

Therefore, the object of the disclosure is to provide a belt sander that can alleviate the drawback of the prior art.

According to the disclosure, a belt sander includes a main casing, a power unit, a belt unit, and a positioning unit.

The power unit is mounted in the main casing, and has a rotating shaft that is adapted to be driven by electric power to rotate about a first axis.

The belt unit includes a belt casing and an abrasive belt. The belt casing is rotatably connected to the main casing, defines a track groove being open toward the power unit and surrounding the rotating shaft, and has a plurality of engaging portions arranged around the track groove and the rotating shaft. Each of the engaging portions defines a notch that is in spatial communication with the track groove. The abrasive belt is mounted in the belt casing, and is configured to be driven by the rotating shaft.

The positioning unit includes a positioning member that is movably mounted to the main casing, and that is adapted for manual operation, and an engaging member that is co-movably connected to the positioning member. The positioning member is movable relative to the main casing along a second axis transverse to the first axis between an engaging position, where the engaging member extends into the notch of a selected one of the engaging portions such that the engaging member is engaged with the selected one of the engaging portions, and a releasing position, where the engaging member is disengaged from the engaging portions. The engaging position is farther away from the rotating shaft than the releasing position.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
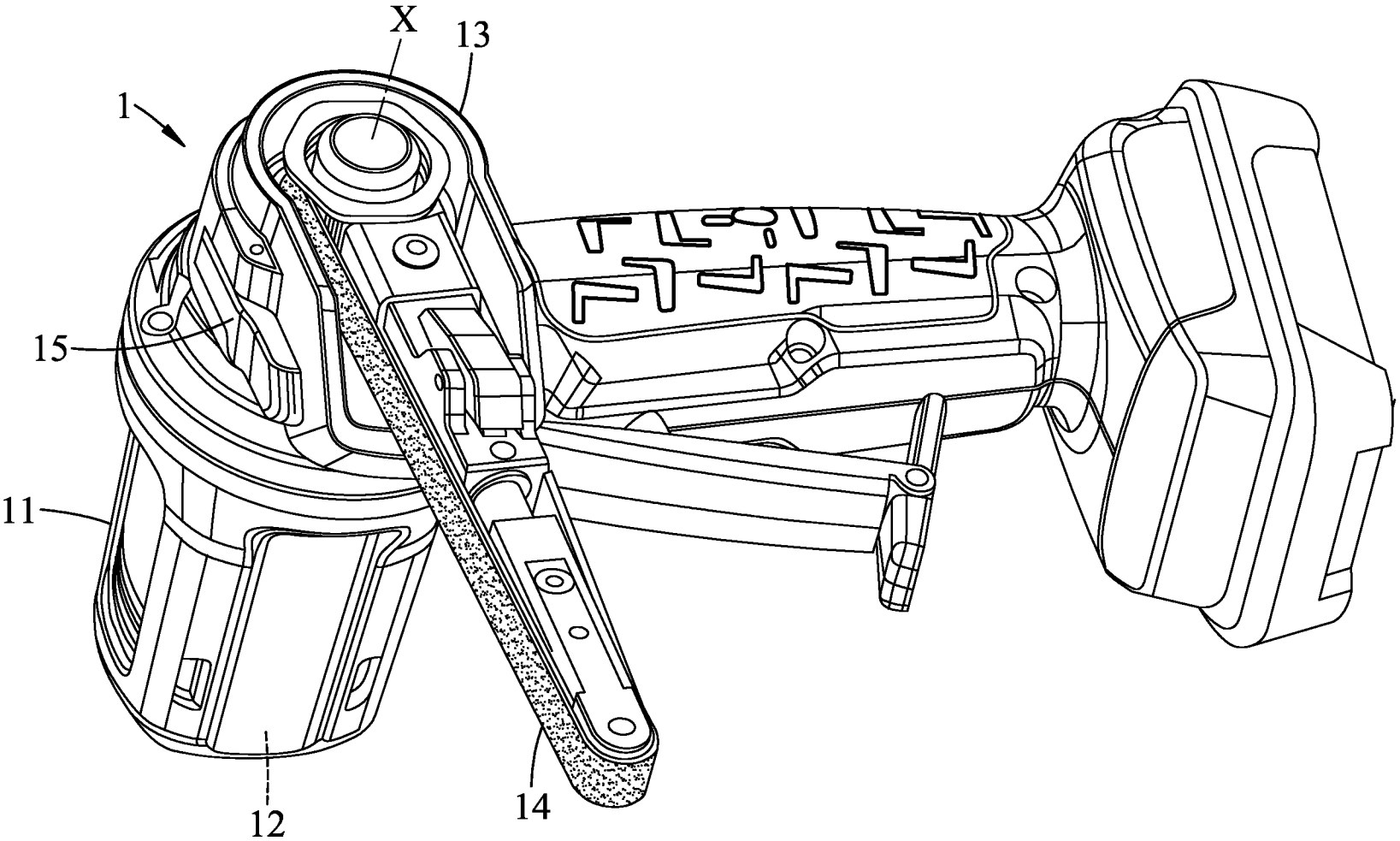
FIG.1 PRIOR ART
FIG. 1 is a perspective view illustrating a conventional belt sander disclosed in U.S. Pat. No. 10,427,270.
Figure 2:
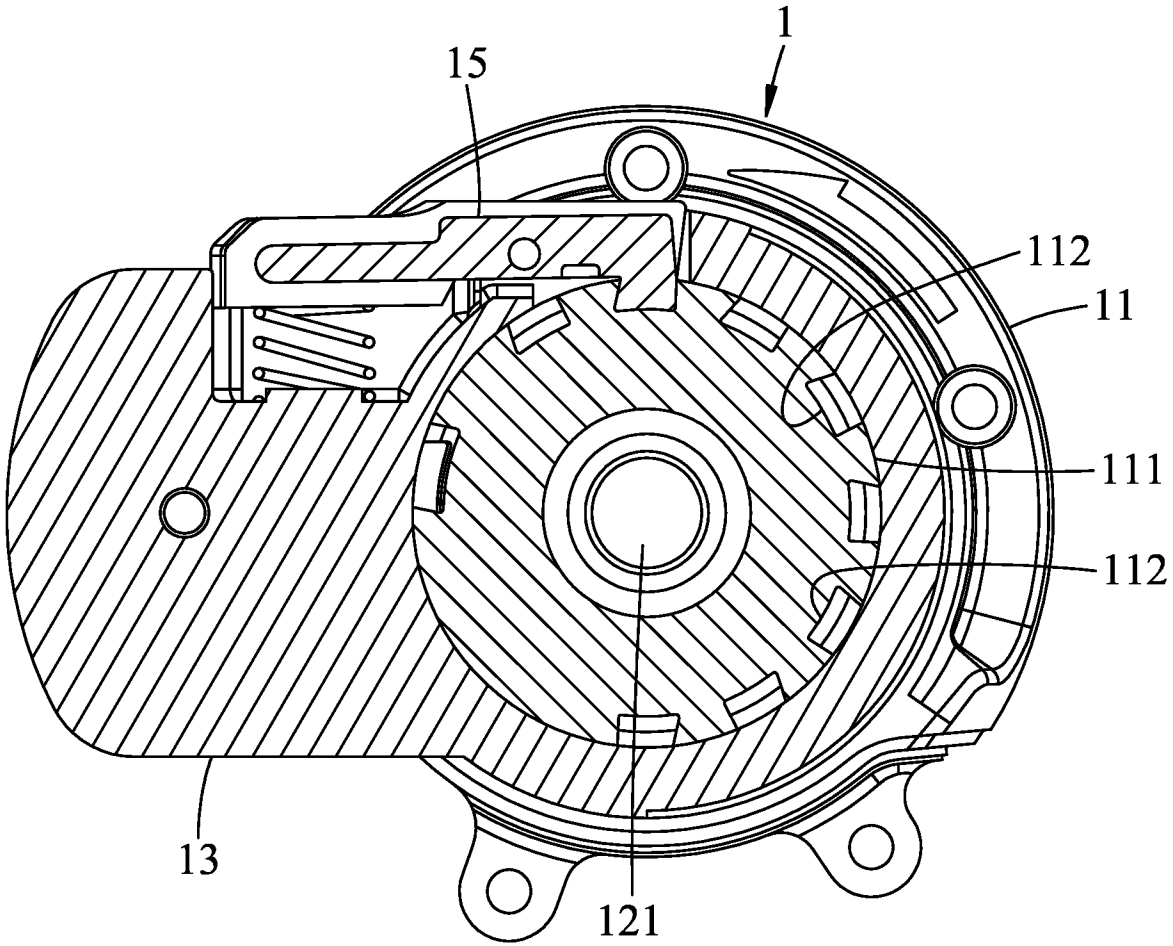
FIG.2 PRIOR ART
FIG. 2 is a sectional view of the conventional belt sander.
Figure 3:
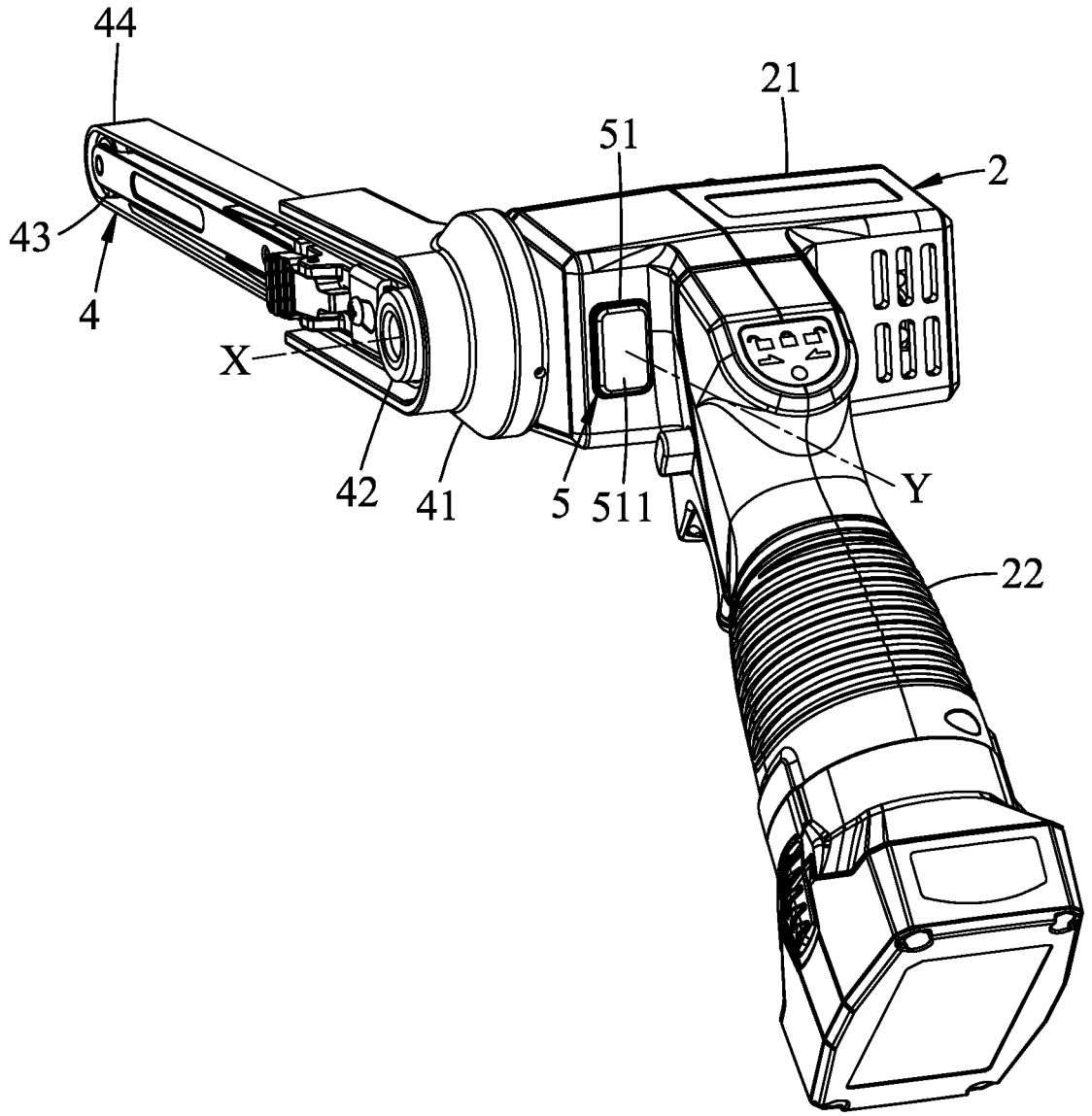
FIG. 3 is a perspective view illustrating an embodiment of a belt sander according to the disclosure.
Figure 4:
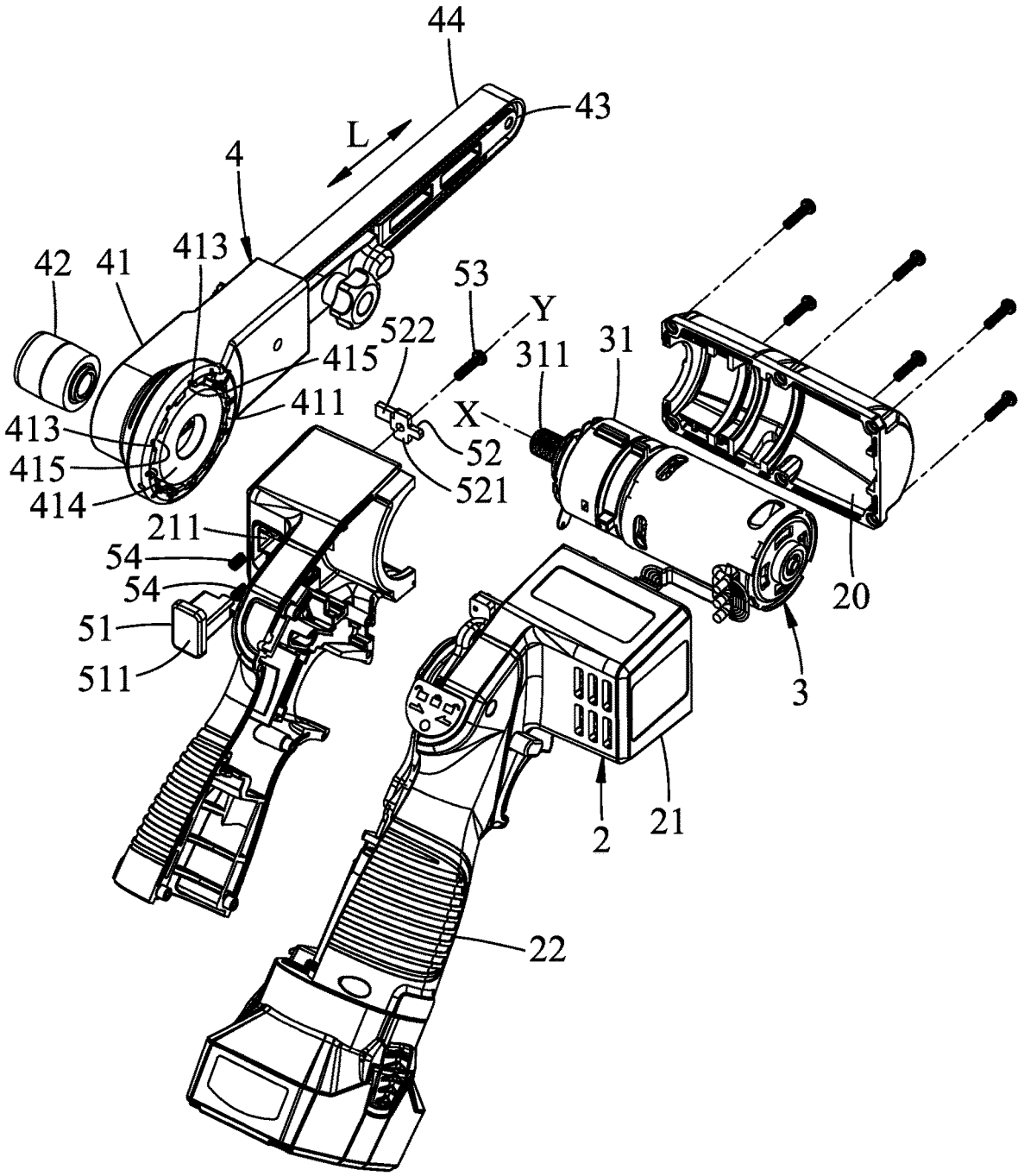
FIG. 4 is an exploded perspective view of the embodiment.
Figure 5:
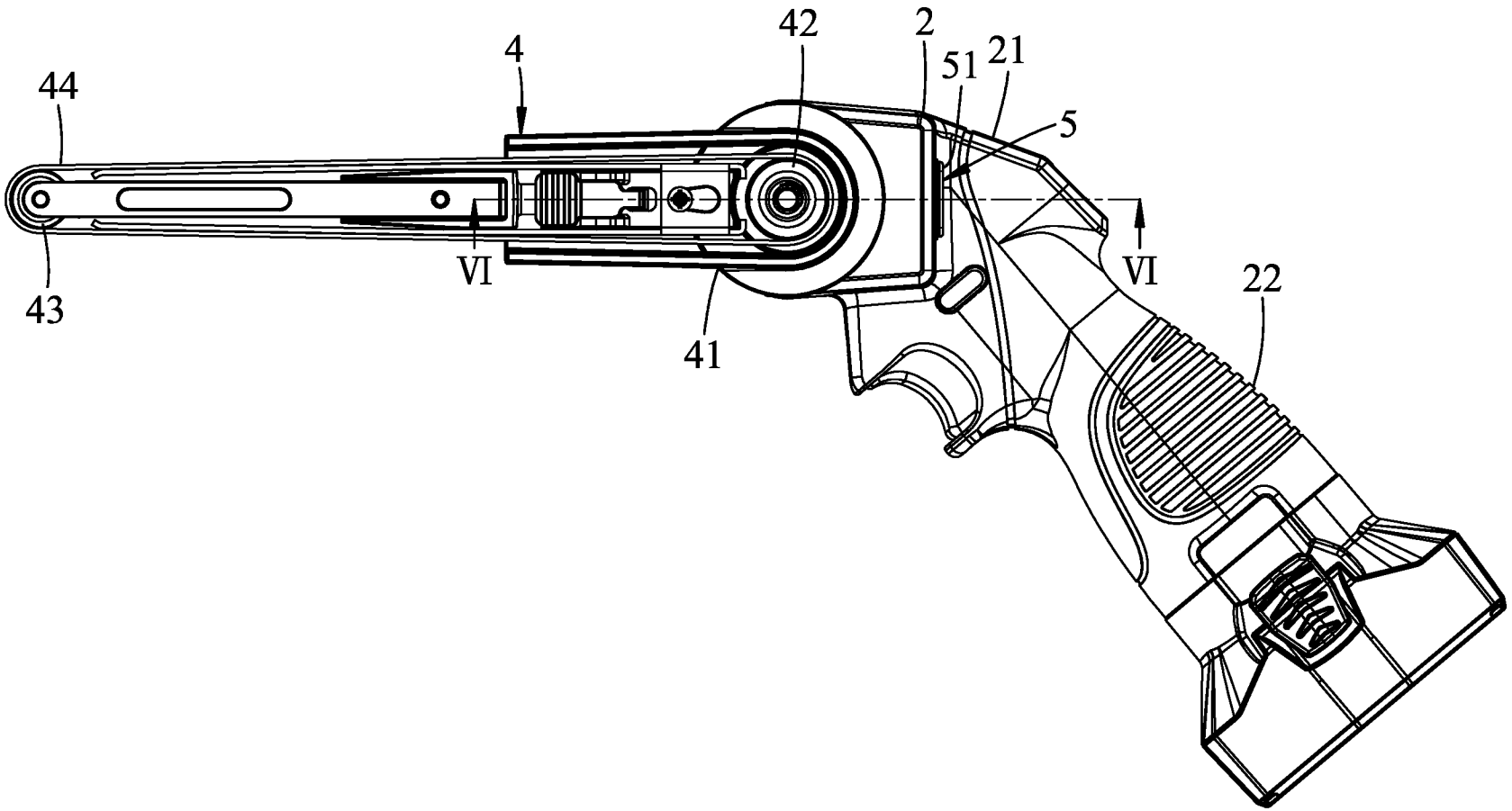
FIG. 5 is a side view of the embodiment.

Referring to FIGS. 3, 4 and 5, an embodiment of a belt sander according to the disclosure includes a main casing 2, a power unit 3, a belt unit 4, and a positioning unit 5.

The main casing 2 includes a main portion 21 and a handle portion 22. The main portion 21 surrounds a first axis (X), defines a receiving space 20, and has a channel 211 extending along a second axis (Y) which is transverse to the first axis (X), spatially communicated with the receiving space 20, and having an opening formed in an outer surface of the main portion 21. In the present embodiment, the second axis (Y) is substantially perpendicular the first axis (X). The handle portion 22 is transversely connected to the main portion 21, and is connected to the outer surface of the main portion 21 such that the handle portion 22 and the opening of the channel 211 are disposed at the same side of the main portion 21 and are adjacent to each other.

The power unit 3 is mounted in the main portion 21 of the main casing 2, and includes a motor 31 that is disposed in the receiving space 20. The motor 31 has an annular flange 310 that surrounds the first axis (X) and that extends out of the main portion 21 of the main casing 2 (see FIG. 6), and a rotating shaft 311 that extends along the first axis (X) out of the annular flange 310, and that is adapted to be driven by electric power to rotate about the first axis (X).

The belt unit 4 extends along a longitudinal direction (L) that is substantially perpendicular to the first axis (X), and includes a belt casing 41, a driving wheel 42, a driven wheel 43, an abrasive belt 44, and a retaining ring 45.

Figure 6:
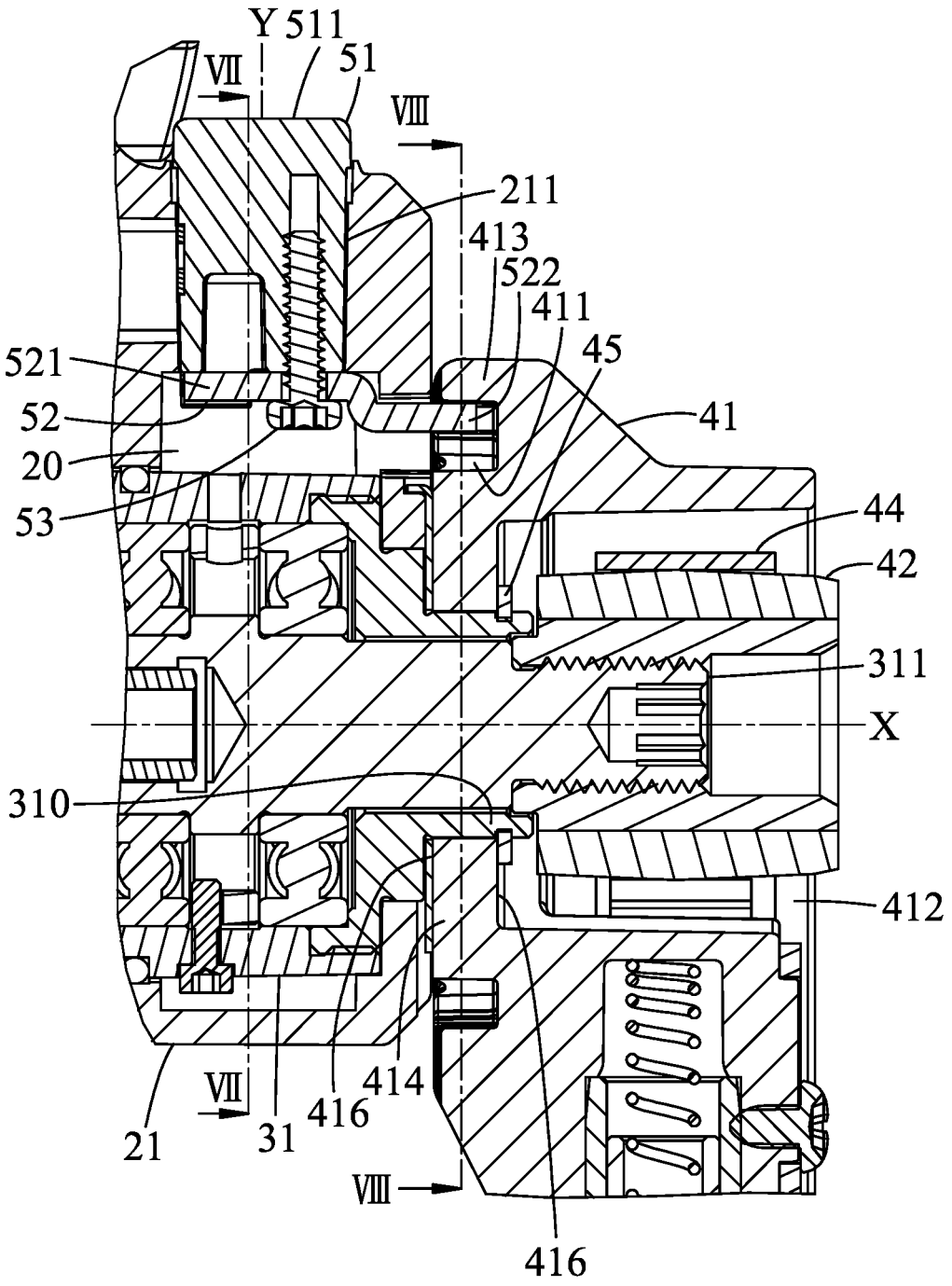
FIG. 6 is a fragmentary sectional view taken along line VI-VI in FIG. 5, illustrating a positioning member being in an engaging position.

Referring to FIGS. 3, 4 and 6, the belt casing 41 of the belt unit 4 is rotatably connected to the main casing 2 and sleeved on the annular flange 310 of the motor 31, defines a track groove 411 and a wheel slot 412, and has a plurality of engaging portions 413 and a sleeve wall 414. The track groove 411 is open toward the power unit 3 and surrounds the rotating shaft 311. The wheel slot 412 is open away from the power unit 3. The engaging portions 413 are arranged around the track groove 411 and the rotating shaft 311. Each of the engaging portions 413 defines a notch 415 that is in spatial communication with the track groove 411. The sleeve wall 414 is disposed between the track groove 411 and the wheel slot 412, and has two abutment surfaces 416 that face away from each other and toward the main casing 2 and the wheel slot 412, respectively.

The driving wheel 42 of the belt unit 4 is co-rotatably connected to the rotating shaft 311, and is disposed in the wheel slot 412. The driven wheel 43 is rotatably connected to the belt casing 41, and is spaced apart from the driving wheel 42 along the longitudinal direction (L). The abrasive belt 44 is mounted in the belt casing 41, is looped around the driving wheel 42 and the driven wheel 43, and is configured to be driven by the rotating shaft 311.

The retaining ring 45 is disposed in the wheel slot 412 of the belt casing 41, surrounds the annular flange 310 of the motor 31 and abuts against a corresponding one of the abutment surfaces 416 of the sleeve wall 414 such that the sleeve wall 414 is positioned rotatably between the main casing 2 and the annular flange 310 and that movement of the belt casing 41 on the annular flange 310 along a direction of the first axis (X) is prohibited.

The positioning unit 5 is mounted to the main portion 21 of the main casing 2 and includes a positioning member 51, an engaging member 52, a bolt 53, and two resilient members 54.

The positioning member 51 extends along the second axis (Y), is movably mounted to the main casing 2, is disposed in the channel 211 of the main portion 21, and is adapted for manual operation. The positioning member 51 has a pressing surface 511 that is exposed outwardly from the channel 211 of the main portion 21 for manual operation.

The engaging member 52 extends along the first axis (X), is co-movably connected to the positioning member 51, and has a connection portion 521, and an engaging portion 522 that is connected to the connection portion 521, and that extends into the track groove 411 and the notch 415 of a selected one of the engaging portions 413. The bolt 53 extends through the connection portion 521 of the engaging member 52 to engage threadedly the positioning member 51 for fastening the engaging member 52 to the positioning member 51.

Figure 7:
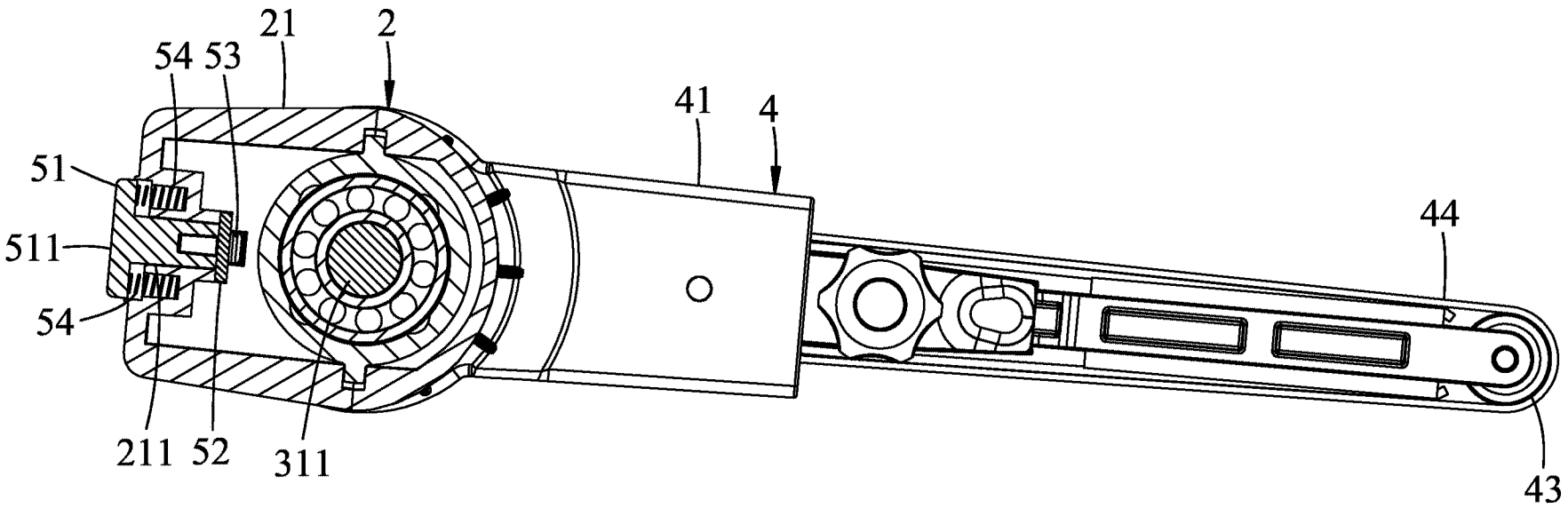
FIG. 7 is a sectional view taken along line VII-VII in FIG. 6, illustrating two resilient members biasing the positioning member to the engaging position.
Figure 8:
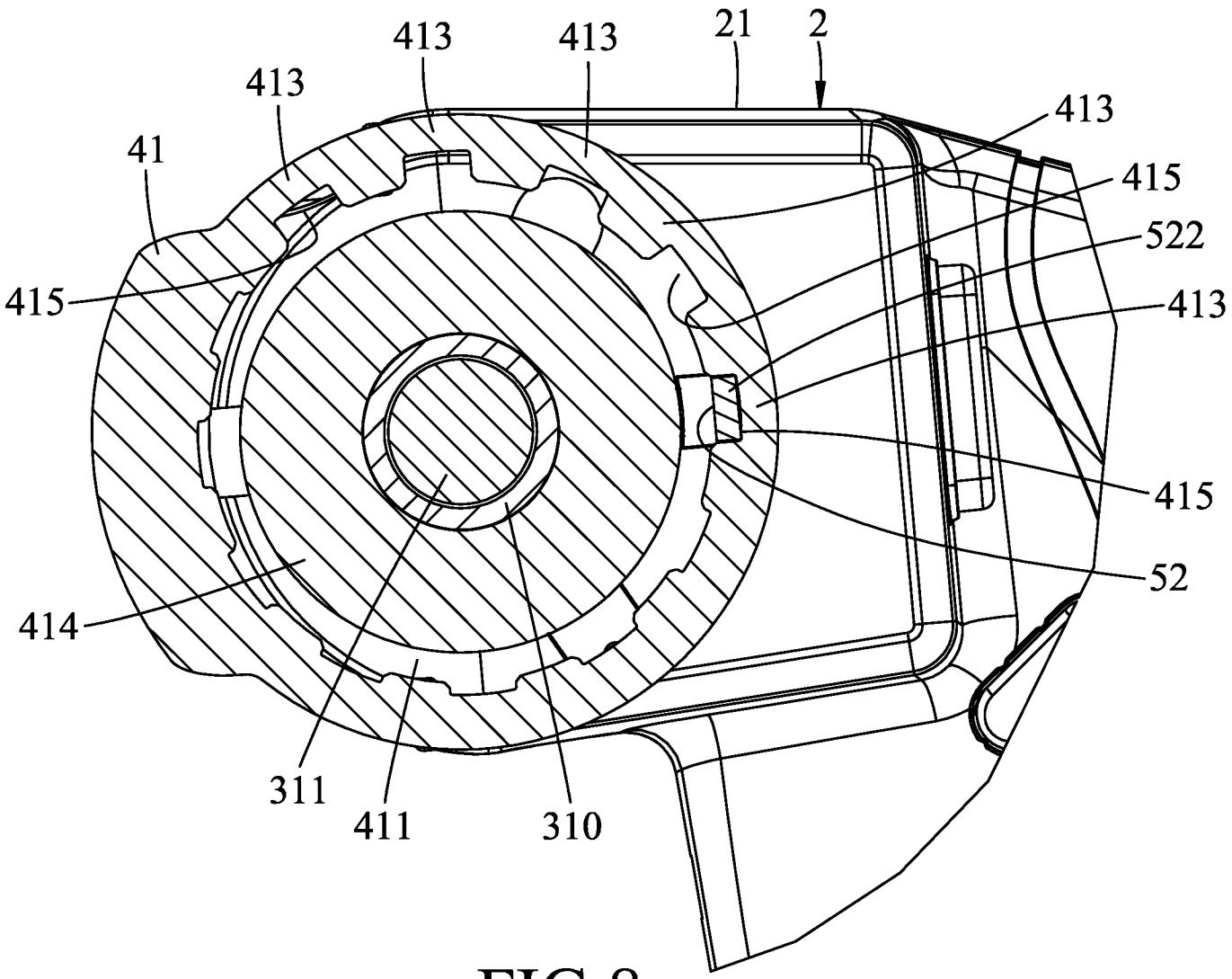
FIG. 8 is a fragmentary sectional view taken along line VIII-VIII in FIG. 6, illustrating an engaging member extending into a notch.

Referring to FIGS. 6 and 7, the resilient members are disposed between and abut against the positioning member 51 and the main portion 21 of the main casing 2 for biasing the positioning member 51 away from the rotating shaft 311 of the power unit 3.

Figure 9:
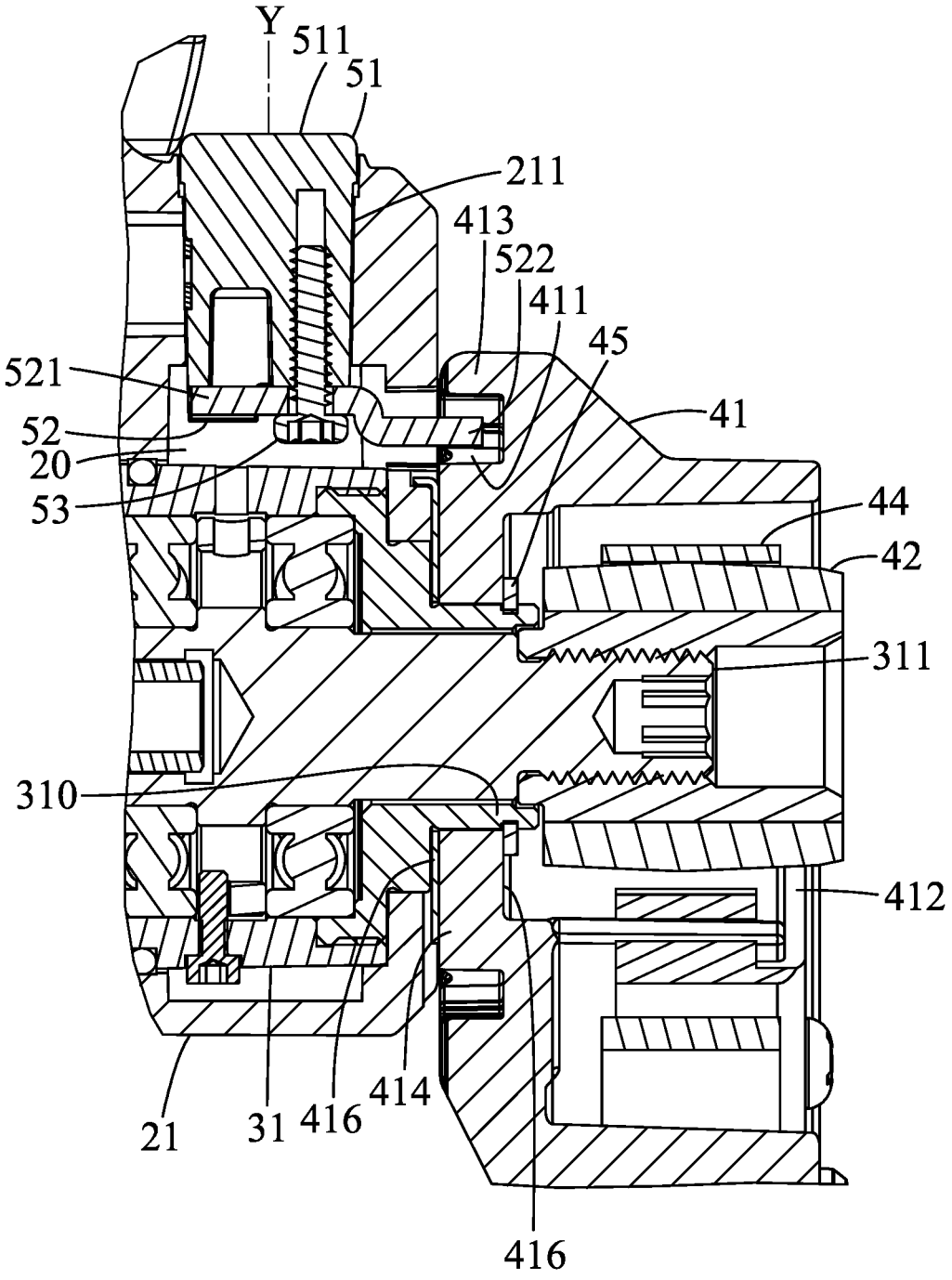
FIG. 9 is a sectional view similar to FIG. 6, but illustrating that the positioning member is disposed at a releasing position.
Figure 10:
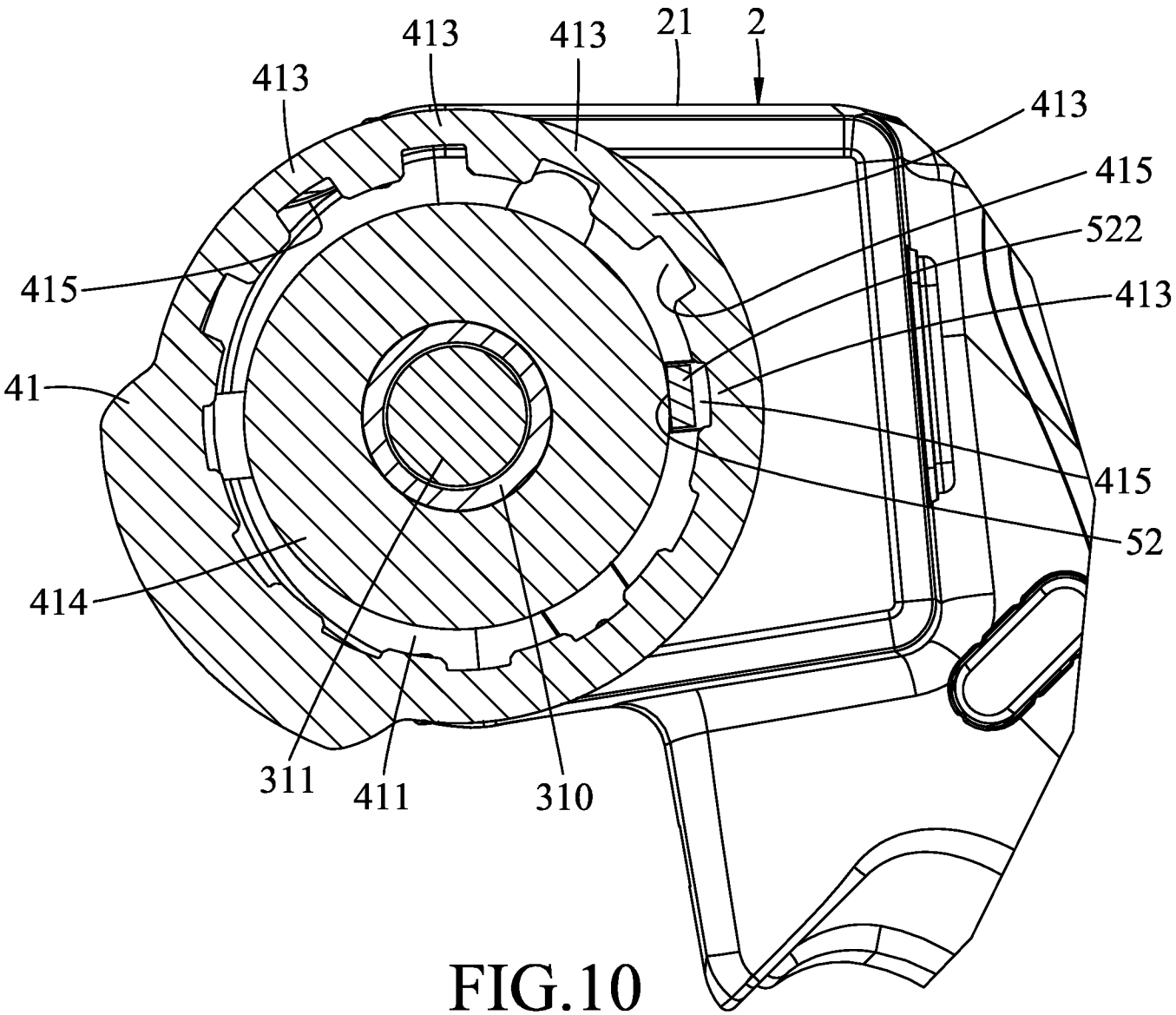
FIG. 10 is a sectional view similar to FIG. 8, but illustrating that the engaging member extends into a track groove.

The positioning member 51 is movable relative to the main casing 2 along the second axis (Y) between an engaging position (see FIG. 6) and a releasing position (see FIG. 9). When the positioning member 51 is at the engaging position, the engaging portion 522 of the engaging member 52 extends into the notch 415 of a selected one of the engaging portions 413 such that the engaging member 52 is engaged with the selected one of the engaging portions 413. When the positioning member 51 is at the releasing position, the engaging member 52 is disengaged from the engaging portions 413, and the engaging portion 522 of the engaging member 52 extends into the track groove 411. The engaging position is farther away from the rotating shaft 311 than the releasing position.

Referring to FIGS. 3, 6, 7 and 8, when the positioning member 51 is not manually operated, the positioning member 51 is biased by the resilient members 54 to stay at the engaging position by default. At this time, the engaging portion 522 of the engaging member 52 extends into the notch 415 of a selected one of the engaging portions 413 of the belt casing 41 and abuts against the selected one of the engaging portions 413, such that rotation of the belt casing is prohibited. As such, the belt unit 4 is positioned with respect to the main casing 2 at a desired angular position, and when the motor 31 (see FIG. 4) drives the rotating shaft 311 to rotate, the driving wheel 42 rotates with the rotating shaft 311 and in turns drives the abrasive belt 44 for grinding or polishing an object (not shown).

Figure 11:
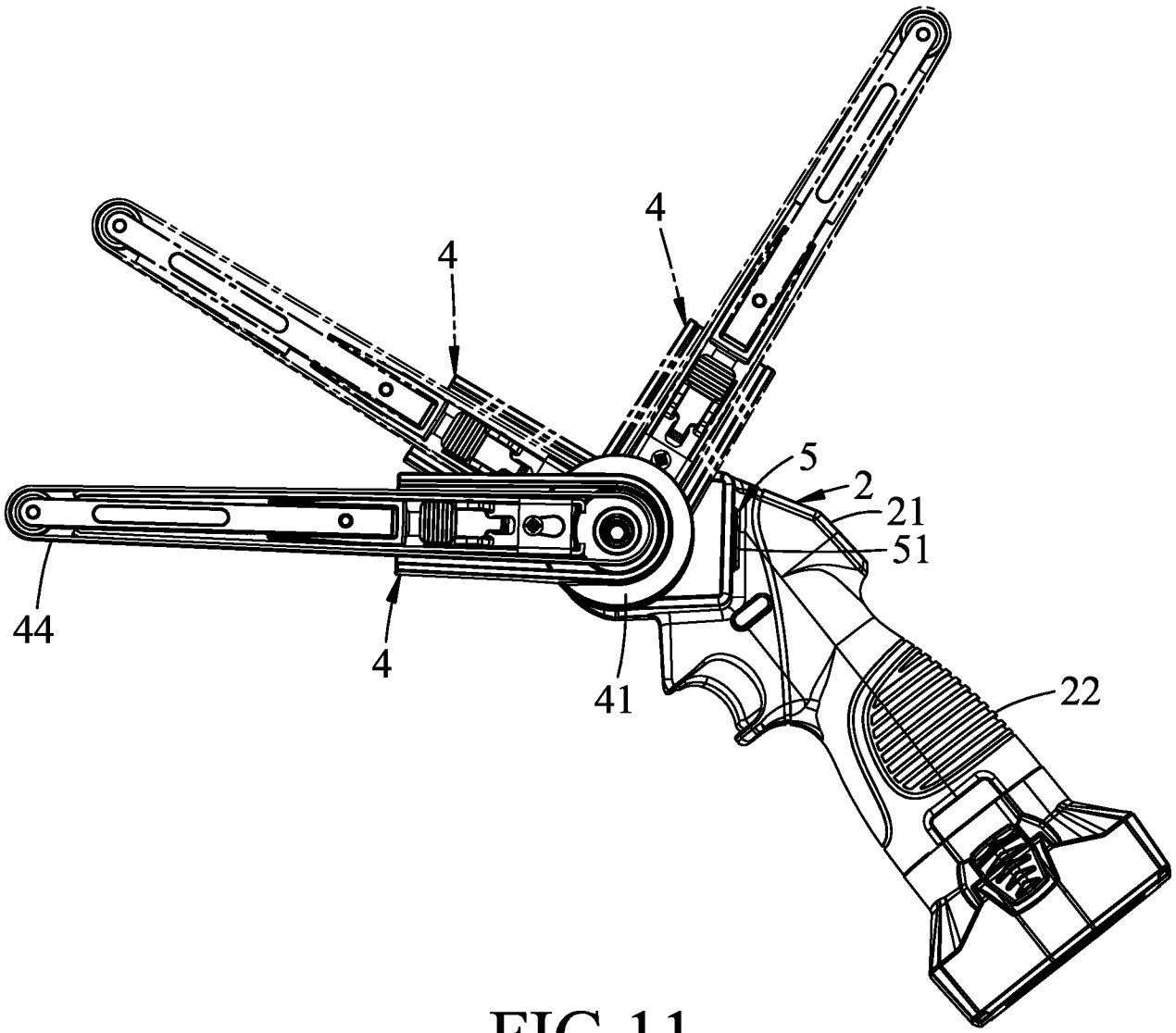
FIG. 11 is a schematic side view illustrating a belt unit of the embodiment being adjusted to different working angles.

Referring to FIGS. 3, 7, 9 and 10, since the pressing surface 511 of the positioning member 51 is adjacent to the handle portion 22 of the main casing 2, when the angular position of the belt unit 4 is to be adjusted, a user is allowed to use only a finger of his/her hand that is gripping the handle portion 22 to press against the pressing surface 511, so as to overcome the biasing force of the resilient members 54 and move the positioning member 51 to the releasing position without releasing the grip of his/her hand. During this time, the engaging member 52 is driven by the positioning member 51 to move toward the rotating shaft 311. Once the engaging portion 522 is separated from the engaging portion 413 and moves into the track groove 411, the user is able to rotate the belt casing 41 of the belt unit 4 freely to any desired angular position, and then release the positioning member 51. When the positioning member 51 returns to the engaging position, the engaging member 52 becomes engaged with a corresponding one of the engaging portions 413 of the belt casing 41, and the belt unit 4 is again positioned with respect to the main casing 2 at the desired angular position. As such, the user is able to adjust the belt casing 41 to different working angles (see FIG. 11) to suit various requirements and needs.

In sum, the present embodiment of the belt sander has benefits as follows.

By virtue of the positioning member 51 being mounted to the main casing 2 with the pressing surface 511 disposed adjacent to the handle portion 22 of the main casing 2, the user is allowed to operate the positioning member 51 while gripping the handle portion 22 with only one hand, and at the same time, his/her other hand can be used to rotate the belt casing 41 of the belt unit 4, resulting in a smoother and more convenient operating process compared to the prior art.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A belt sander comprising:

a main casing;

a power unit mounted in said main casing, and having a rotating shaft that is adapted to be driven by electric power to rotate about a first axis;

a belt unit including:

a belt casing that is rotatably connected to said main casing, that defines a track groove being open toward said power unit and surrounding said rotating shaft, and that has a plurality of engaging portions arranged around said track groove and said rotating shaft, each of said engaging portions defining a notch that is in spatial communication with said track groove, and an abrasive belt that is mounted in said belt casing, and that is configured to be driven by said rotating shaft;

and a positioning unit including:

a positioning member mounted on said main casing, being linearly movable along a second axis and non-rotatable about the first axis, and adapted for manual operation, the second axis being transverse to the first axis, and an engaging member that is co-movably connected to said positioning member, said positioning member being movable relative to said main casing along the second axis between an engaging position, where said engaging member extends into said notch of a selected one of said engaging portions such that said engaging member is engaged with said selected one of said engaging portions, and a releasing position, where said engaging member is disengaged from said engaging portions, an entirety of said engaging member being further away from said rotating shaft when at the engaging position than at the releasing position;

wherein said main casing includes a main portion that has a channel extending along the second axis and having an opening formed in an outer surface of said main portion, said positioning unit being mounted to said main portion, said positioning member of said positioning unit being disposed in said channel of said main portion and having a pressing surface that is exposed outwardly from said channel for manual operation;

wherein said engaging member of said positioning unit has a connection portion, and an engaging part that is connected to said connection portion, said engaging part extending into said track groove and said notch of the selected one of said engaging portions;

wherein said engaging part that extends into said track groove and said notch is at a distance along the first axis away from said positioning member.

2. The belt sander as claimed in claim 1, wherein said belt unit extends along a longitudinal direction that is substantially perpendicular to the first axis.

3. The belt sander as claimed in claim 2, wherein:

said belt casing of said belt unit further defines a wheel slot that is open away from said power unit; and said belt unit further includes a driving wheel that is co-rotatably connected to said rotating shaft, and that is disposed in said wheel slot, and a driven wheel that is rotatably connected to said belt casing, and that is spaced apart from said driving wheel along the longitudinal direction, said abrasive belt being looped around said driving wheel and said driven wheel.

4. The belt sander as claimed in claim 3, wherein said belt casing of said belt unit further has a sleeve wall that is disposed between said track groove and said wheel slot, and that has two abutment surfaces being facing away from each other and toward said main casing and said wheel slot, respectively.

5. The belt sander as claimed in claim 4, wherein:

said power unit includes a motor that has said rotating shaft, and that further has an annular flange surrounding said rotating shaft and extending out of said main casing, said belt casing of said belt unit being rotatably sleeved on said annular flange of said motor; and said belt unit further includes a retaining ring that is disposed in said wheel slot of said belt casing, that surrounds said annular flange of said motor and abuts against a corresponding one of said abutment surfaces of said sleeve wall such that said sleeve wall is positioned rotatably between said main casing and said annular flange and movement of said belt casing on said annular flange along a direction of the first axis is prohibited.

6. The belt sander as claimed in claim 1, wherein said main casing further includes a handle portion that is transversely connected to said main portion, said power unit being mounted to said main portion.

7. The belt sander as claimed in claim 6, wherein said handle portion is connected to said outer surface of said main portion such that said handle portion and said opening of said channel are disposed at one side of said main portion and are adjacent to each other, such that a finger of a hand of a user gripping said handle portion is allowed to press against said pressing surface of said positioning member of said positioning unit.

8. The belt sander as claimed in claim 1, wherein said positioning unit further includes a bolt that extends through said connection portion of said engaging member to engage threadedly said positioning member for fastening said engaging member to said positioning member.

9. The belt sander as claimed in claim 1, wherein said positioning unit further includes at least one resilient member that is disposed between and abuts against said positioning member and said main casing for biasing said positioning member away from said rotating shaft of said power unit.

10. The belt sander as claimed in claim 1, wherein said positioning member extends along the second axis, said engaging member extending along the first axis, the first axis and the second axis intersecting and being substantially perpendicular to each other.

* * * * *